US006539591B1

(12) United States Patent
Blanco

(10) Patent No.: US 6,539,591 B1
(45) Date of Patent: Apr. 1, 2003

(54) TIE ROD PULLER

(76) Inventor: Rolando Blanco, 150 E. 1st. Ave., Apt. 511, Hialeah, FL (US) 33010

( * ) Notice: Subject to any disclaimer, the term of this patent is extended or adjusted under 35 U.S.C. 154(b) by 0 days.

(21) Appl. No.: 10/045,410

(22) Filed: Oct. 19, 2001

(51) Int. Cl.[7] ..... E04C 5/08; F16G 11/04

(52) U.S. Cl. ..... 24/136 R; 24/136 B; 249/40; 249/219.1; 52/223.13

(58) Field of Search ..... 24/136 R, 136 B, 24/115 M, 191, 127.5, 127.6, 135 R; 52/223.13; 249/40, 219.1; 425/129.1; 403/314

(56) References Cited

U.S. PATENT DOCUMENTS 2,075,239 A * 3/1937 Strange ..... 24/19 X
2,171,120 A * 8/1939 Bullard ..... 24/19 X
3,117,485 A * 1/1964 Jansen ..... 411/427
3,910,546 A * 10/1975 Connors ..... 24/136 R
3,920,214 A * 11/1975 Lovisa et al. ..... 249/40
5,282,603 A * 2/1994 Taraldsson ..... 249/40 X
5,594,977 A 1/1997 McCallion ..... 24/136
5,762,815 A * 6/1998 Lee ..... 249/40
6,470,636 B1 * 10/2002 Rose ..... 52/223.13 X

* cited by examiner

*Primary Examiner*—Robert J. Sandy
(74) *Attorney, Agent, or Firm*—Albert Bordas; J. Sanchelima

(57) ABSTRACT

A construction tool to facilitate tie rod and key plate installation onto concrete forms, primarily comprising a housing and an extraction assembly. The extraction assembly having means to slidably journal generally within the housing. The housing has a movable plate assembly at one end that has a protrusion outwardly extending therefrom. The protrusion is uniquely shaped to mount a key plate thereon. Additionally, the housing has brackets mounted at opposite sides of the movable plate, which provide space for the extraction assembly to mount onto the end of a tie rod. Operationally, a key plate is mounted onto the protrusion, said invention is placed onto the approach side of a concrete form, and an extraction head of the extraction assembly is placed onto the tie rod end and pulled sufficiently to allow placement of the key plate onto an interlocking notch of the tie rod, thus securing the concrete form.

4 Claims, 3 Drawing Sheets

TIE ROD PULLER

BACKGROUND OF THE INVENTION

1. Field of the Invention

The present invention relates to a construction tool, and more particularly, to a construction tool that includes a tie rod puller to facilitate tie rod and key plate installation onto concrete forms.

2. Description of the Related Art

Many designs for tie rod pullers have been designed in the past. None of them, however, include an extraction assembly having means to slidably journal generally within a housing, where the housing has a movable plate assembly at one end. The movable plate assembly has a protrusion outwardly extending therefrom that is uniquely shaped to mount a key plate. Additionally, the housing has brackets mounted at opposite sides of the movable plate assembly, which provide space for the extraction assembly to mount onto the end of a tie rod. In operation, a key plate is mounted onto the protrusion, the instant invention is placed onto the approach side of a concrete form. The extraction head of the extraction assembly is placed onto the tie rod end and pulled sufficiently to allow placement of the key plate onto an interlocking notch of the tie rod, thus securing the concrete form.

Applicant believes that the closest reference corresponds to U.S. Pat. No. 5,594,977 issued to McCallion for Smooth Rod-Gripping Apparatus. However, it differs from the present invention because McCallion teaches an apparatus for gripping a smooth, fiberglass rod. The apparatus comprising a housing, a jaw cluster within the housing, and a force tube for positioning the jaw cluster within the housing. The rod-gripping apparatus includes a first aperture and a second aperture, which facilitate passage of a rod through the apparatus. The force tube is mechanically interfitted with the jaw cluster. The jaw cluster comprises a plurality of elongated jaw members, which are generally wedge-shaped, and complementary to an inner tapered wall of the housing. The jaw cluster, which surrounds the rod, is set to or released from the rod, as desired, in response to a repositioning of the force tube relative to the housing. Therefore, the patented mechanism involves the use of an apparatus for gripping a smooth, fiberglass rod, whereas the present invention provides for the mounting of a key plate thereon, thereby facilitating its installation after a tie rod has been pulled by said present invention.

Other patents describing the closest subject matter provide for a number of more or less complicated features that fail to solve the problem in an efficient and economical way. None of these patents suggest the novel features of the present invention.

SUMMARY OF THE INVENTION

A construction tool, comprising a housing assembly having first and second ends. The first end has an end cap with an aperture, the second end has at least two brackets mounted thereon and a plate assembly. The brackets are at opposite sides of said plate assembly. The housing has movable means to move said plate assembly. The plate assembly has a groove and further has a protrusion with mating cooperative characteristics to receive a key plate. A pull assembly comprises an operational screw, passing through the aperture of the end cap, connects a handle and an extractor. The extractor comprises another groove to facilitate positioning and securing of a tie rod end. The instant invention has sliding means to slidably journal the extractor relative to said housing. Said end cap is mechanically interfitted to cooperate with said operational screw, in response to a rotation of said handle, so that said tie rod end is selectively brought in alignment with said first groove and secured with said second groove, thereby having unobstructed travel that permits the operation of said construction tool.

More specifically, the construction tool facilitates tie rod and key plate installation onto concrete forms. In greater detail, an embodiment may comprise a first housing having first and second ends. The first end having an end cap with an aperture, said second end having brackets mounted thereon. The first housing comprising a second housing mounted thereon. The second housing comprising a spring member that houses a shaft. The shaft secures a plate assembly, whereby said spring causes said plate assembly to bias against said second end. The plate assembly having a groove and further having a protrusion with mating cooperative characteristics to receive a key plate. A pull assembly with seventh and eighth ends comprises an operational screw, passing through said aperture, connecting a handle and an extractor, said extractor comprising a second groove, which is generally wedge-shaped, and complementary to facilitate positioning and securing of a tie rod end. Similarly, this embodiment has sliding means to slidably journal said extractor relative to said housing whereby said end cap is mechanically interfitted to cooperate with said operational screw, in response to a rotation of said handle, so that said tie rod end is selectively brought in alignment with said first groove and secured with said second groove, thereby having unobstructed travel that permits the operation of said construction tool.

The instant invention may cooperate with a variety of tie rod and key plate assemblies. However, in the preferred embodiment, the tie rod is a construction form tie comprising an elongated rod having a substantially straight middle portion of uniform cross-section. One end of the tie rod being formed with engager means adapted for operative engagement with a first chuck of an electric drill. The other end of the tie rod terminating in a drill bit larger in diameter than said middle portion. The engager means comprising a pair of diametrically-opposed wings and a second chuck having a shank adapted to be engageable in said first chuck of said electric drill. The rod being formed adjacent to said engager and adjacent to said drill bit with rows of spaced pairs of opposed squared notches adapted to be lockingly engaged with said key plates on opposite sides of said construction form.

It is therefore one of the main objects of the present invention to facilitate withdrawal of a tie rod end from a concrete form.

It is one of the main objects of the present invention to provide an apparatus to pull a tie rod to enable a user to safely place a key plate thereon.

It is another object of this invention to provide a safe and efficient tie rod puller that may be utilized by the user.

It is still another object of the present invention to provide a tie rod puller that may temporarily extract a tie rod end sufficiently to place a key plate thereon.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
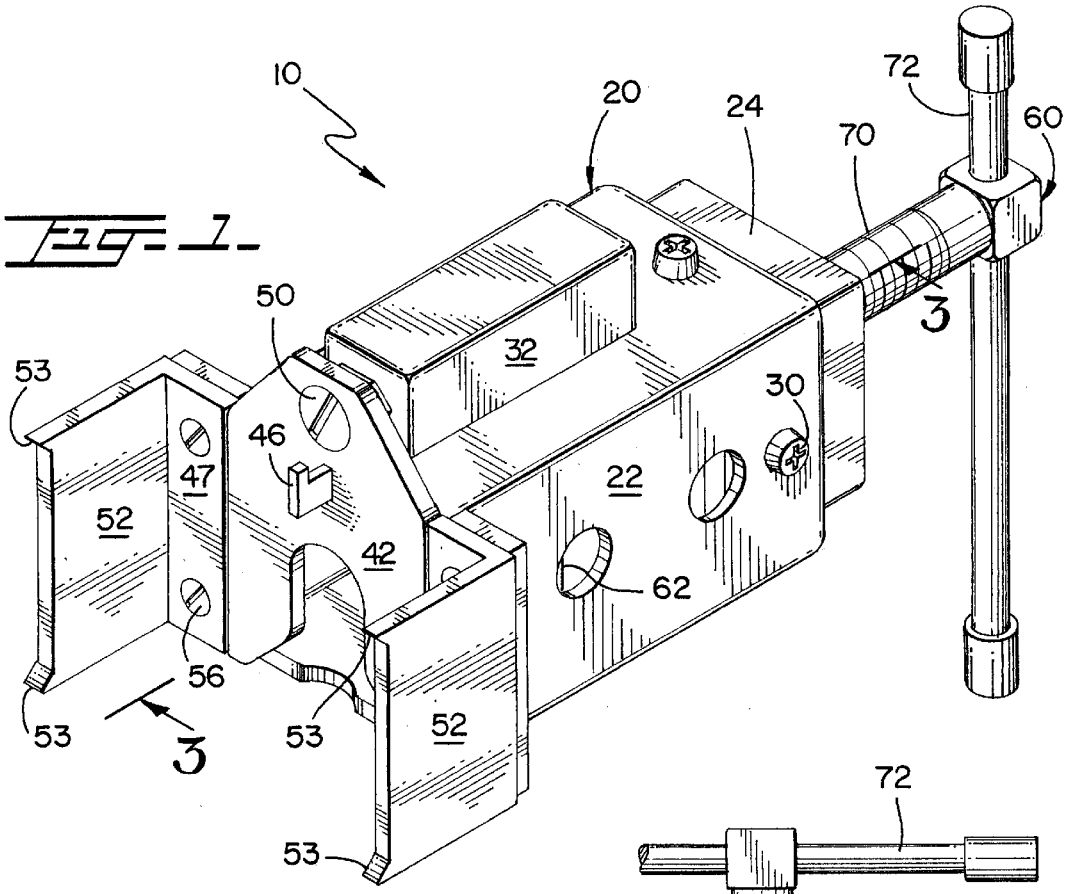
FIG. 1 represents a perspective view of the instant invention.

Referring now to the drawings, where the present invention is generally referred to with numeral 10, it can be observed that it basically includes pull housing 20 and pull assembly 60.

Figure 4:
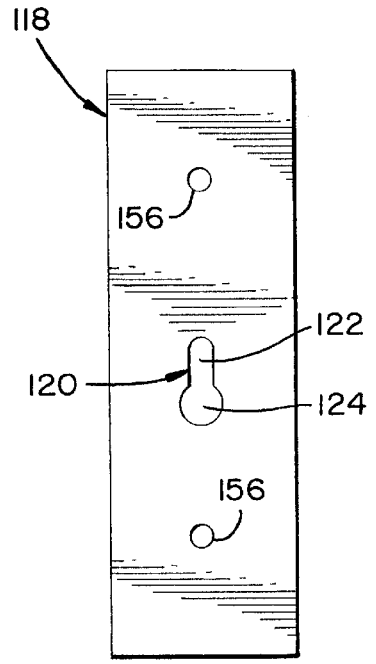
FIG. 4 illustrates an elevation view of a key plate.
Figures 2, 5, 6, 7, 8, 9:
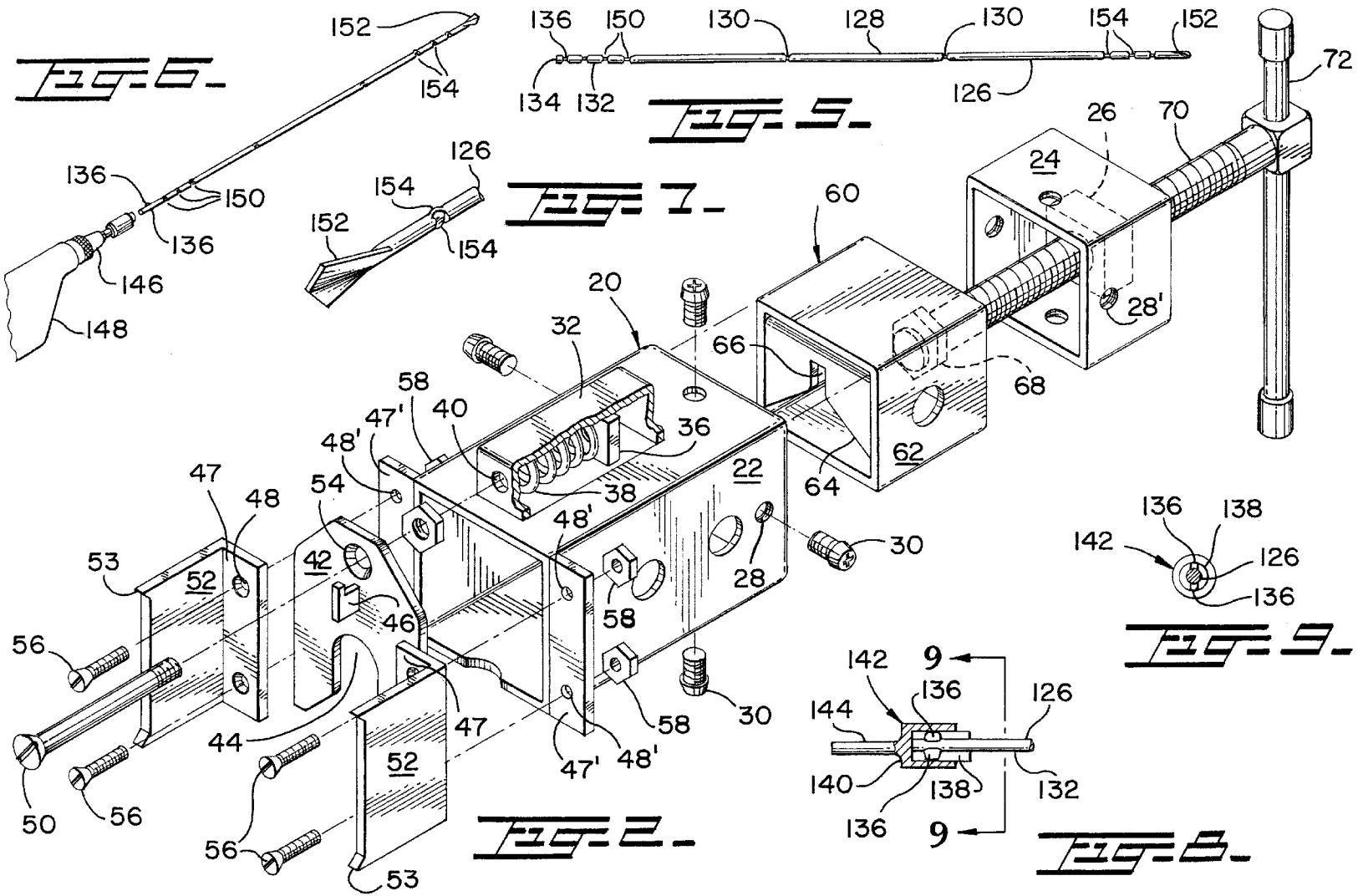
FIG. 2 shows an exploded view of the instant invention.
FIG. 5 is a side elevation of the rod.
FIG. 6 is a fragmentary perspective view, on a reduced scale, showing the tie rod about to be engaged in the chuck of an electric drill.
FIG. 7 is an enlarged fragmentary perspective view of the boring bit end of the tie rod.
FIG. 8 is a side elevation, partly broken away and in section, showing the chuck end of the tie rod engaged in a special electric drill chuck.
FIG. 9 is a transverse section taken on the line 9—9 of FIG. 8.

As seen in FIG. 1, instant invention 10 is a construction tool utilized to pull tie rods, such as the one shown in FIG. 5, from concrete forms. Pull assembly 60 is partially housed within pull housing 20. Handle 72 is utilized for leverage to rotate operating screw 70 in a clock-wise or counter clock-wise direction. Operational screw 70 trespasses case end 24 of pull housing 20 and is secured to housing 62, best seen in FIG. 2. Plate 42 is biased towards case 22 of pull housing 20 by spring 38, seen in FIG. 2, inside housing 32. Plate 42 has protrusion 46 extending perpendicularly therefrom. Protrusion 46 is uniquely shaped to complement keyhole opening 120 of key plate 118, seen in FIG. 4. The shape of protrusion 46 prevents key plate 118 from swiveling upon plate 42. Brackets 52 have end points 53. End points 53 are sufficiently pointy to grip spaced wales 114, seen in FIGS. 10*a* and 10*b*, and prevent pull housing 20 from rotating when handle 72 is rotated.

As best seen in FIG. 2, handle 72 is perpendicularly slidably connected to operating screw 70 of pull assembly 60. Operating screw 70 extends from handle 72, through case end 24 of pull housing 20, and is secured by nut 68. Case end 24 has case end nut 26 centrally disposed in the preferred embodiment. Case end nut 26 is fixed upon case end 24 so as to not move or rotate. Case end 24 also has at least one hole 28' to receive screw 30. Pull assembly 60 further comprises housing 62. Housing 62 has a cavity within. Opposite the face where nut 68 is secured, is another face having edges 64 angled toward groove 66.

Housing 62 slidably travels and snugly fits within case 22 of pull housing 20. Case 22 is generally rectangular in the preferred embodiment to cooperate with the shape of housing 62. Case 22 has at least one hole 28 that aligns with hole 28' when case end 24 is introduced thereon. Screw 30 trespasses hole 28 and secures within hole 28'. Protruding from a top section of case 22 is housing 32. Housing 32 houses spring 38 and nut plate 36. Nut plate 36 is shaped to slidably cooperate within housing 32 and receives a threaded end of bolt 50. Bolt 50 trespasses hole 54 of plate 42 and hole 40 of housing 32, through spring 38, and secures to nut plate 36. Plate 42 is uniquely shaped with groove 44. Groove 44 is aligned with and is wider than groove 66 of housing 62. Perpendicularly extending from plate 42 is protrusion 46. Extending in opposite directions and perpendicularly from case 22 are flanges 47'. Having mating characteristics to flanges 47' are brackets 52. Brackets 52 have flanges 47 that mate with flanges 47' when biased upon. Screws 56 trespass holes 48 of flanges 47 and holes 48' of flanges 47'. Nut 58 secures screw 56 to keep brackets 52 mounted to case 22. Brackets 52 also have end points 53 that are pointy.

Figure 3:
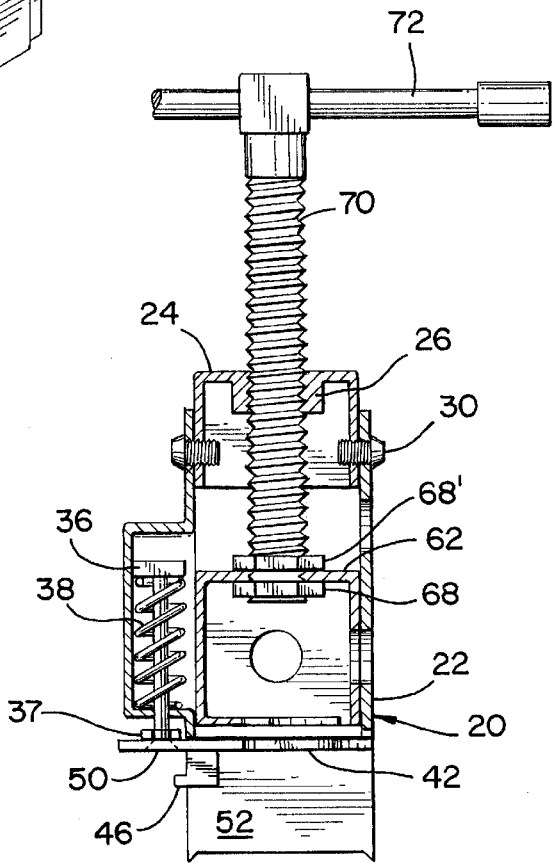
FIG. 3 illustrates a cut view of the instant invention taken along the line 3—3 of FIG. 1.

As seen in FIG. 3, operational screw 70 is affixed to housing 62 with a means to secure. Such means are nuts 68' and 68, or an equivalent. Operational screw 70 screws in and out of case end 24 with case end nut 26, this action results in housing 62 sliding within case 22 of pull housing 20. As best seen in this figure, the spring force of spring 38 keeps plate 42 biased against case 22. Bolt 50 is secured to nut plate 36 and spring 38 receives bolt 50 therethrough. Additionally, nut 37 secures bolt 50 to plate 42.

Described below are a tie rod and key plate assembly with characteristics that cooperate with instant invention 10. However, other tie rod and key plate assemblies with similar characteristics may be utilized by instant invention 10.

Figure 10A:
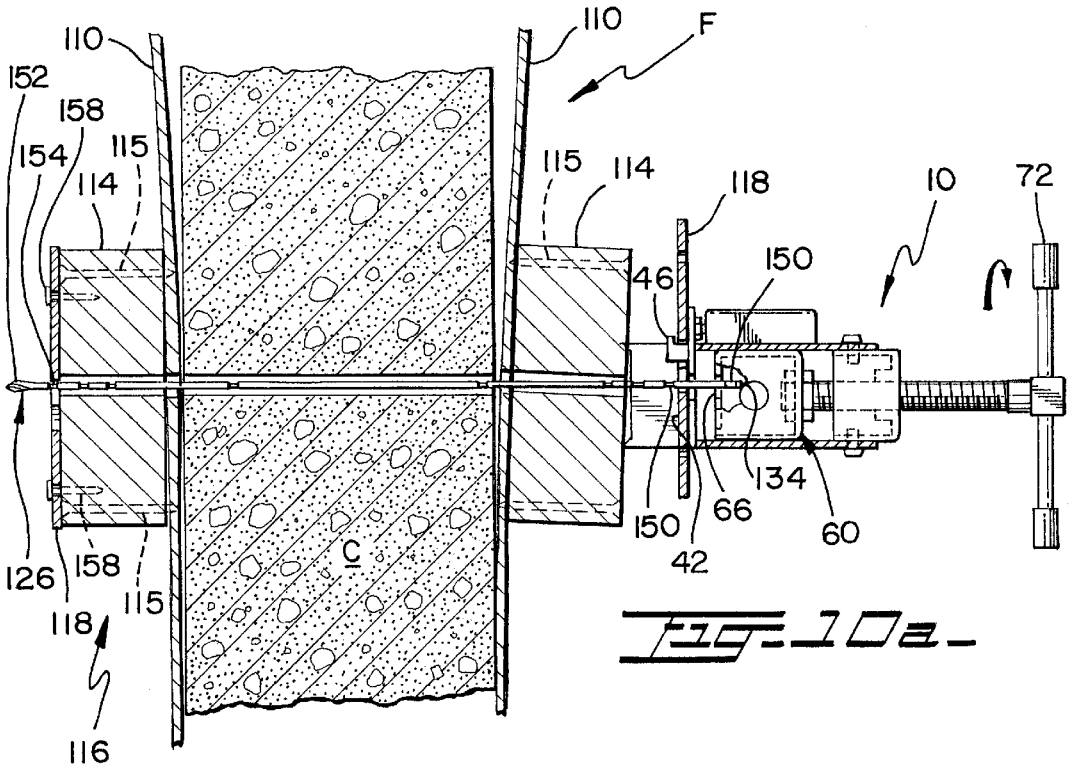
FIG. 10*a* is a representation of the instant invention pulling the tie rod.
Figure 10B:
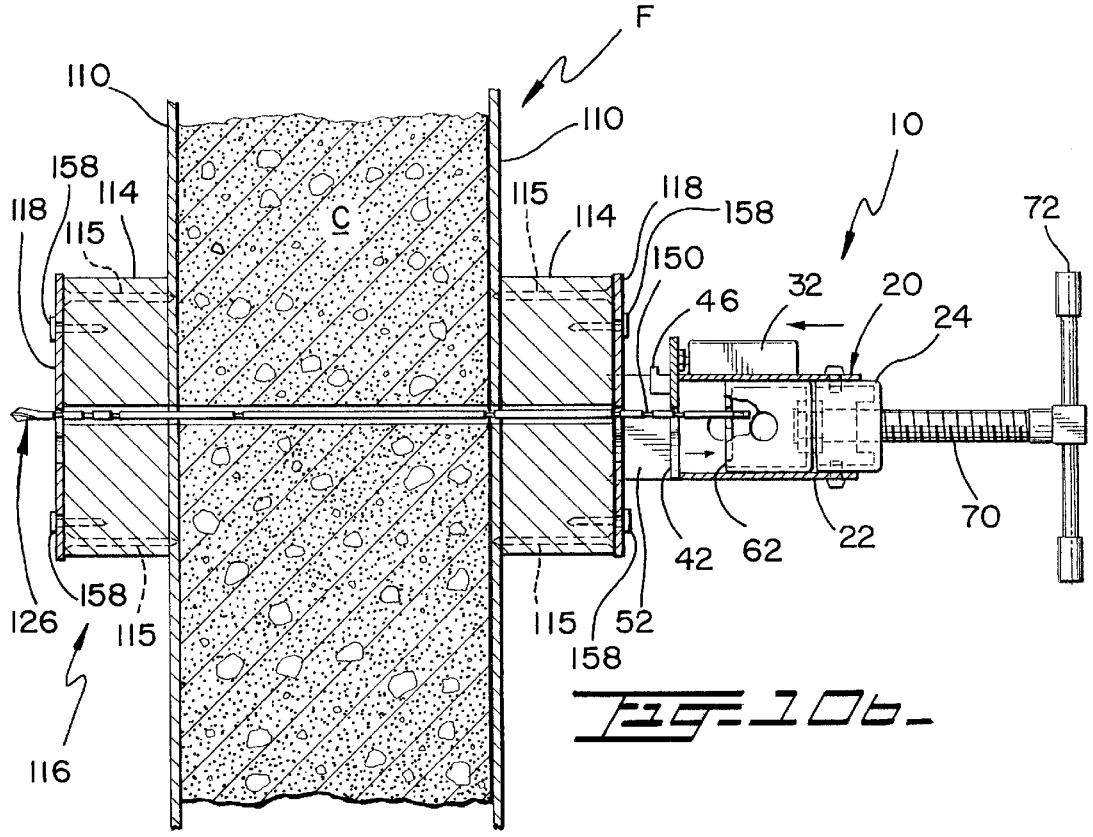
FIG. 10*b* is a representation of the instant invention having pulled the tie rod with the key plates securing the tie rod.

Seen in FIG. 4 is key plate 118 adapted to bear against and span wales 114, seen in FIG. 10*b*, at selected intervals there-along. Key plate 118 is vertically elongated and rectangular in shape. Key plate 118 has vertically elongated keyhole opening 120, comprising vertical slot 122 narrower than tie rod 126, seen in FIG. 5, which opens to large diameter round hole 124. Key plates 118 are cut to define angled wedges along the sides of slot 122. When key plate 118 is pressed downwardly from hole 124 of the keyhole opening 120 and into slot 122, key plates 118 are wedgingly locked to squared notches 150 or 154 at related ends of tie rod 126.

As seen in FIGS. 5, tie rod 126 has a main central portion 128, which is smooth, except for two or more weakened areas, defined by opposed V-shaped notches 130. The main portion 128 of the tie rod merges into a chuck end portion 132, which is formed, adjacent to the tie rod end 134, with a pair of diametrically opposed flat rectangular wings 136.

As shown in FIGS. 6, 8 and 9, wings 136 are adapted to be non-rotatably secured in a longitudinal slot 138, formed in the head 140 of a drill chuck 142, having a shank 144 adapted to be secured in the chuck 146 of electric drill 148. This special chuck arrangement, in conjunction with wings 136, enables merely pulling the drill off the tie rod, when the drilling has been completed, instead of taking the time to release the tie rod from a conventional drill chuck. Near to but spaced inwardly from wings 136, the tie rod is formed with a row equally longitudinally spaced, opposed squared notches 150, which are adapted to accommodate instant invention 10 for withdrawing tie rod 126 from concrete form F, seen in FIG. 10*a*.

As shown in FIG. 7, tie rod 126 terminates at its other end, in a double-way boring bit 152, which is larger in diameter than the tie rod. A row of tool accommodating square notches 154, similar to the notches 150, is formed in the rod adjacent to and inwardly of the bit 152.

In FIGS. 10*a* and 10*b*, a concrete form F is shown, which comprises laterally spaced panels 110, of such as plywood, against parallel spaced wales 114. A poured filling of concrete is between panels 110. Assembly 116 comprises, for each pair of key plates 118, a single tie rod 126, which is longer than the thickness of the concrete form F.

As seen in FIG. 10*a*, in use and operation, wales 114 are secured to panels 110, with nails 115, on both the remote side and the approach side of form F. Boring bit 152 of tie rod 126 is then measured upon the approach side of concrete form F, until the bit end engages the adjacent wale 114. The chuck end of tie rod 126 is then engaged in the special drill chuck 142 and drilling begun by actuating electric drill 148 and exerting forward pressure. When boring bit 152 shows through the remote form panel 110 and wale 114, key plate 118 is secured. Key plate 118, which is formed with nail holes 156, above and below key-hole opening 120, is nailed, as indicated at 158, through holes 156, to wale 114, at the remote side of form F.

As shown, spaced panels 110 typically flare outwardly initially, and most squared notches 150 of tie rod 126 remain within wale 114 of the approach side of form F. Pull means are necessary to properly secure tie rod 126. Pull on tie rod 126 is applied with instant invention 10, whereby pull is applied to squared notches 150, so as to align form panels 110 and properly position tie rod 126 relative to form F.

A key plate 118 is placed onto protrusion 46 of plate 42. Instant invention 10 is positioned so that tie rod end 134 is in between brackets 52. Handle 72 is turned, until groove 66, seen in FIG. 2, of housing 62, secures upon a squared notch 150. In some cases, housing 62 will protrude from case 22 to reach a squared notch 150. Spring 38 allows plate 42 to travel upon housing 62. Handle 72 is then turned in the opposite direction to pull tie rod 126.

As seen in FIG. 10*b*, once tie rod 126 is pulled, key plate 118 is removed from protrusion 46 and set upon related square notch 150, so as to wedgingly lock the tie rod in place into the vertical slots 122, relative to form F. Tie rod 126 is left, in entirety, in place of form F.

It has been found, in on-site practice, that tie rod 126 can be installed substantially more safely, easily and quickly when utilizing the instant invention.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A construction tool, comprising:

A) a housing assembly having first and second ends, said first end having an end cap with an aperture, said second end having at least two brackets mounted thereon and a plate assembly, wherein said brackets are at opposite sides of said plate assembly, said housing having movable means to move said plate assembly, said plate assembly having a first groove and further having a protrusion outwardly extending a first predetermined distance from said plate assembly with mating cooperative characteristics to receive a key plate;

B) a pull assembly comprising an operational screw, passing through said aperture, connecting a handle and an extractor, said extractor comprising a second groove to facilitate positioning and securing of a tie rod end; and C) sliding means to slidably journal said extractor relative to said housing whereby said end cap is mechanically interfitted to cooperate with said operational screw, in response to a rotation of said handle, so that said tie rod end is selectively brought in alignment with said first groove and secured with said second groove, thereby having unobstructed travel that permits the operation of said construction tool.

2. A construction tool to facilitate tie rod and key plate installation onto concrete forms, comprising:

A) a first housing having first and second ends, said first end having an end cap with an aperture, said second end having brackets mounted thereon, said first housing comprising a second housing with third and fourth ends, mounted a first predetermined distance from said first end, a second predetermined distance towards said second end, without reaching said second end, said second housing comprising a spring member with fifth and sixth ends, said spring housing a shaft which secures a plate assembly, said fifth end coacts against said third end, keeping said spring biased towards said third end, selectively causing said plate assembly to bias against said second end, said plate assembly having a first groove and further having a protrusion outwardly extending a third predetermined distance with mating cooperative characteristics to receive a key plate;

B) a pull assembly with seventh and eighth ends comprising an operational screw, passing through said aperture, connecting a handle and an extractor, said extractor comprising a second groove, which is generally wedge-shaped, and complementary to facilitate positioning and securing of a tie rod end; and C) sliding means to slidably journal said extractor relative to said first housing whereby said end cap is mechanically interfitted to cooperate with said operational screw, in response to a rotation of said handle, so that said tie rod end is selectively brought in alignment with said first groove and secured with said second groove, thereby having unobstructed travel that permits the operation of said construction tool.

3. The construction tool set forth in claim 1, wherein said tie rod having third and fourth ends, is a construction form tie comprising an elongated rod having a substantially straight middle portion of uniform cross-section, said third end portion of said tie rod being formed with engager means adapted for operative engagement with a first chuck of an electric drill, said fourth end terminating in a drill bit larger in diameter than said middle portion, said engager means comprising a pair of diametrically-opposed wings and a second chuck having a shank adapted to be engageable in said first chuck of said electric drill, said tie rod being formed adjacent to said engager and adjacent to said drill bit with rows of spaced pairs of opposed squared notches adapted to be lockingly engaged with said key plates on opposite sides of said construction form.

4. The construction tool to facilitate tie rod and key plate installation onto concrete forms set forth in claim 2, wherein said tie rod having ninth and tenth ends, is a concrete form tie comprising an elongated rod having a substantially straight middle portion of uniform cross-section, said ninth end portion of said tie rod being formed with engager means adapted for operative engagement with a first chuck of an electric drill, said tenth end terminating in a drill bit larger in diameter than said middle portion, said engager means comprising a pair of diametrically-opposed wings and a second chuck having a shank adapted to be engageable in said first chuck of said electric drill, said tie rod being formed adjacent to said engager and adjacent to said drill bit with rows of spaced pairs of opposed squared notches adapted to be lockingly engaged with said key plates on opposite sides of said concrete form.

* * * * *